US005188046A

United States Patent [19]

Badillo

[11] Patent Number: 5,188,046

[45] Date of Patent: Feb. 23, 1993

[54] PLASTIC BOBBIN BASKET WITH DAMAGE RESISTANT MEMBERS

[75] Inventor: Paul Badillo, Littleton, Colo.

[73] Assignee: Bakron Corp., Buffalo Grove, Ill.

[21] Appl. No.: 647,343

[22] Filed: Jan. 29, 1991

[51] Int. Cl.[5] ..... D05B 57/26

[52] U.S. Cl. ..... 112/231

[58] Field of Search ..... 112/231, 228, 230, 261, 112/181

[56] References Cited

U.S. PATENT DOCUMENTS

| | | | |
|---|---|---|---|
| 2,219,308 | 10/1940 | Haas | 112/38 |
| 3,016,033 | 1/1962 | Herbst | 112/232 |
| 4,665,850 | 5/1987 | Shimizu | 112/231 |
| 4,676,178 | 6/1987 | Hirose | 112/231 |
| 4,858,543 | 8/1989 | Badillo | 112/231 |

*Primary Examiner*—Peter Nerbun

*Attorney, Agent, or Firm*—Clement and Ryan

[57] ABSTRACT

A bobbin basket for use with a rotary loop-taker in a lock-stitch sewing machine is disclosed. The basket is integrally formed of plastic, with damage resistant members for reducing wear and impact damage at specified locations. The extent of each such location may be only a small fraction of the potential area of wear and damage. Inserts are disclosed for the needle thread stop, the needle thread pick-up notch, the upstream side wall of a rotation-restraining notch, the bearing rib, and the downstream side wall of the rotation-restraining notch.

29 Claims, 2 Drawing Sheets

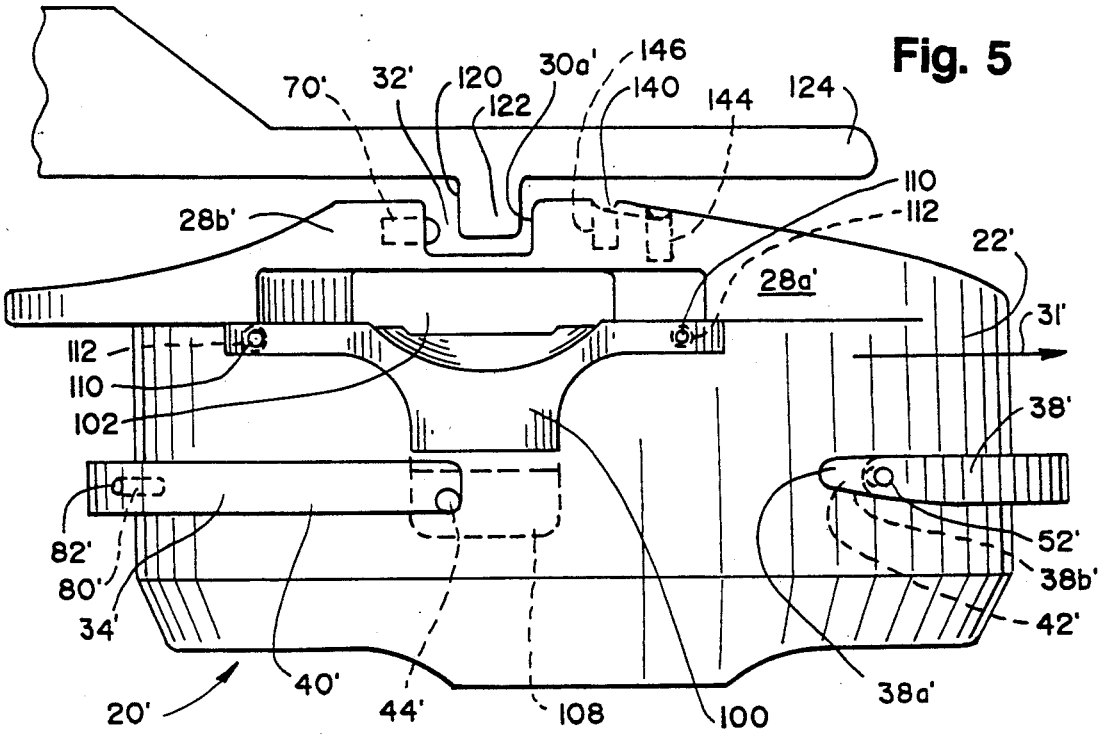
Fig. 5
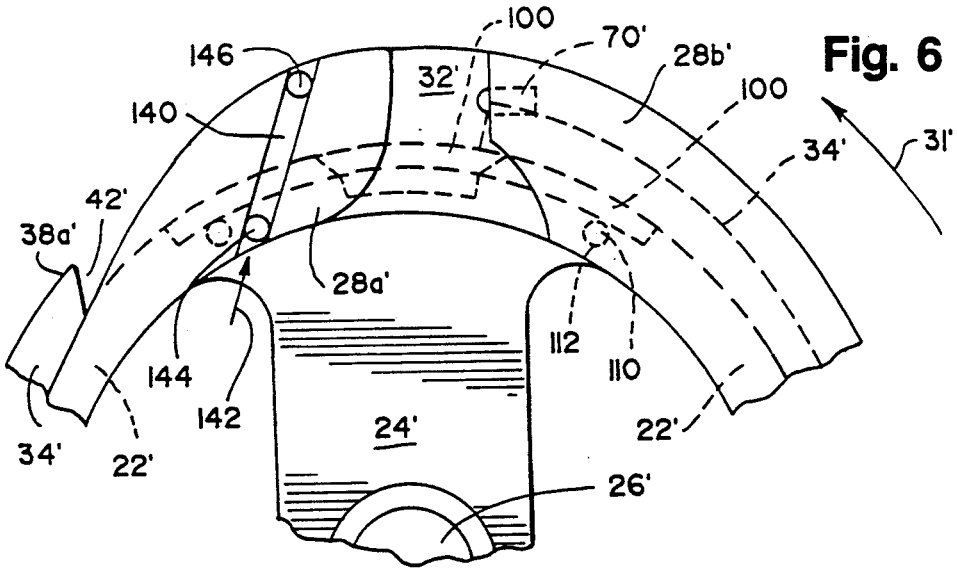
Fig. 6
Fig. 7
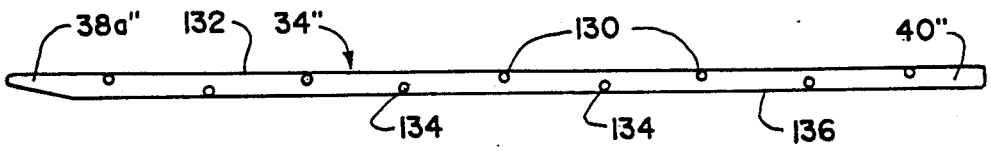

PLASTIC BOBBIN BASKET WITH DAMAGE RESISTANT MEMBERS

FIELD OF THE INVENTION

This invention relates to a bobbin basket for a lock-stitch sewing machine, and more particularly to a plastic bobbin basket that includes members to resist damage to the bobbin basket that might otherwise occur when the basket is used in the sewing machine.

BACKGROUND OF THE INVENTION

This invention complements the invention described and claimed in applicant's U.S. Pat. No. 4,858,543 issued Aug. 22, 1989 and assigned to the assignee of the present invention. The bobbin basket covered by that patent is adapted for use with a horizontal rotary loop taker, which is the term used in the sewing machine industry for rotary loop takers or "hooks" that when installed in a lock-stitch sewing machine have a horizontal axis of rotation. The present invention is useful for any bobbin basket, whether it is adapted for use with a horizontal hook or with a vertical hook.

Prior to the invention disclosed and claimed in U.S. Pat. No. 4,858,543, bobbin baskets used in the industrial sewing machine industry were customarily made of metal, typically steel. Steel bobbin baskets have a number of disadvantages that have been recognized for a very long time. The invention covered by U.S. Pat. No. 4,858,543 took a big step toward providing a bobbin basket that avoids the problems associated with steel bobbin baskets, by providing a plastic bobbin basket of greatly increased usefulness and much longer life than was previously believed to be possible. The present invention goes still farther in increasing the usefulness of a plastic bobbin basket and extending its life.

The many advantages that a bobbin basket formed almost entirely of plastic has over a conventional all steel basket are clear. Molding of the basic plastic piece (with or without the small inserts of the present invention which are described below) is far more convenient and less expensive than the casting or forging—followed by various machining, polishing and hardening steps—that is involved in the production of an all steel bobbin basket. Chattering of the bearing rib in its raceway—which produces chipping and burring, with resulting thread breakage—is avoided with such a plastic bobbin basket. The lower coefficient of friction between the bearing rib and its raceway produces a longer life for the plastic bobbin basket, and avoids the problems of messy lubrication, galling, bluing of the rotary loop taker, and puckering of the goods being sewn that accompany the use of an all steel basket.

As already mentioned above, U.S. Pat. No. 4,858,543 took a big step towards making all these advantages available to the sewing industry. The present invention provides another highly significant advance toward eliminating various types of wear and impact damage that have over the years seemed to deter those skilled in the art from attempting to achieve the highly desirable but presumably impossible goal of a bobbin basket formed almost entirely of plastic.

A number of prior workers in this field have fabricated bobbin baskets partly of plastic and partly of metal, but none of them have utilized this approach to produce a bobbin basket that is formed almost entirely of plastic, as applicant does. Examples of the universal failure to realize that the many significant advantages of a bobbin basket formed almost entirely of plastic are capable of achievement are provided by U.S. Pat. No. 4,108,095 to Kohara, U.S. Pat. No. 4,377,121 to Teranishi, U.S. Pat. No. 4,393,798 to Cheng and U.S. Pat. No. 4,700,643 to Hirose et al. In Kohara, bobbin carrier 32 is comprised of upper member 33, lower member 34 and intermediate member 35, with only the latter member being formed of molded plastic material (col. 2, lines 40–46). In Teranishi, bobbin case 12 is divided into an upper portion 13 made of metal, and a lower portion 14 made of plastic (col. 1, lines 58–60). Cheng's bobbin basket is made up of an upper part, a lower part, and a middle part that constitutes the bearing rib, with that rib being either formed of, or coated with, Teflon (col. 2, line 13). In Hirose et al., only track projection member 27 (the equivalent of a bobbin basket bearing rib) is made of synthetic resin material (col. 4, lines 22–24). It is evident that none of these prior workers in this field recognized the extreme value, or even the possibility, of fabricating a bobbin basket almost entirely of plastic.

U.S. Pat. No. 4,676,178 to Hirose deals with the problem of frictional wear between the bobbin basket bearing rib and its associated raceway by an entirely different, complicated and more expensive expedient—the use of magnets embedded in the bearing rib and raceway with identical magnetic poles opposite each other to produce a repelling force that is expected to keep the rib and raceway from contacting each other. Whether or not this approach is useful in practical application, it is entirely different from applicant's invention.

SUMMARY OF THE INVENTION

Except that the bobbin basket of this invention is formed almost entirely of plastic, the basic configuration of the basket is conventional, including as it does a cylindrical side wall, a flange extending radially outward at the top of the cylindrical side wall with two portions of the flange shaped to form a rotation-restraining notch, and a bearing rib extending outwardly from the cylindrical wall.

The features added by this invention to that basic bobbin basket configuration include damage resistant members for reducing (1) wear on the two bearing rib end portions that together define the needle thread pick-up and release area, (2) wear on the portion of the flange that forms the downstream (relative to the direction of rotation of the rotary loop taker) rotation-restraining notch side wall with which the bobbin thread comes into contact as it exits from the bobbin spool, and (3) wear on the bearing rib body in spite of the contact that is maintained between the rib body and the rotary loop taker raceway in which the rib is journaled, and in addition include a member for minimizing impact damage to the upstream (relative to the direction of hook rotation) rotation-restraining notch side wall that periodically strikes the downwardly extending stud portion of the stationary positioning finger for the bobbin basket. Since the appended claims include subcombination claims to each of these means, the practice of this invention may involve only one, or any number, of these means.

Whatever number of the disclosed damage resistant members is utilized, damage to the plastic bobbin basket caused by wear or impact is correspondingly reduced or minimized. It is believed that under some conditions of operation, any such damage to the bobbin basket can be virtually eliminated through the use of this invention in all its features.

Each damage resistant member for reducing wear just mentioned, whether the wear involved is wear produced by friction or by abrasion, preferably comprises in each case at least one insert embedded securely within the bobbin basket element with which it is associated. The material of which each of these wear-reducing inserts is formed has a substantially lower coefficient of sliding friction, with the element with which it comes into contact in the sewing machine, than the main material of which the bobbin basket is formed does, or is substantially harder than that material, or has a substantially higher heat deflection temperature than that material, or can have any two or three of these properties. Each insert preferably has only a single portion of its exterior surface exposed, which exposed surface portion is smooth, free of sharp edges, and substantially flush with the surrounding surface of the element in which the insert is embedded. Preferred locations for these inserts are disclosed.

At least one portion of the exterior surface of each of said wear-reducing inserts is exposed to contact with a curved, elongated area of the needle thread loop, rotary loop taker raceway, or bobbin thread with which it is associated. The lengthwise radius of curvature of each of said exposed surface portions of the wear-reducing inserts is no greater than—in other words, is equal to or less than—the lengthwise radius of curvature of the immediately surrounding surface of the bobbin basket element with which it is associated.

The member for minimizing impact damage to the upstream side wall of the rotation-restraining notch in the flange at the top of the cylindrical side wall of the bobbin basket of this invention comprises a member securely attached to that side wall. This member preferably has at least one surface exposed to impact from the stud portion of the stationary positioning finger for the bobbin basket. The member is formed of a material that has a substantially higher impact strength than the main material of which the bobbin basket is formed does. This damage resistant member may be an insert securely embedded in the rotation-restraining notch side wall in question. In such case, it is preferred that the insert protrudes a short distance from the surface of the side wall in which it is embedded, and this protruding portion is desirably rounded in shape.

The area occupied by each of the members described above for reducing wear or minimizing impact damage at a given location on the bobbin basket may be only a small fraction of the potential area of wear or impact damage at that given location, or may be as much as the entire area of potential wear or damage at that location. In other words, the area occupied may fall anywhere desired in the indicated range.

BRIEF DESCRIPTION OF THE DRAWINGS

The present invention is described in detail below with reference to the accompanying drawings, in which:

FIG. 5 is a side elevation of another embodiment of the bobbin basket of this invention that is similar to the embodiment of FIGS. 1–4 but has a different form of needle guard plate and is not adapted for use with an undertrimmer, showing the stud carried by the bobbin basket positioning finger inserted in its operative position in the rotation-restraining notch of the bobbin basket;

FIG. 6 is a fragmentary top plan view of the portion of the embodiment of FIG. 5 that is nearest the viewer in the latter Figure; and FIG. 7 is a developed view of the side wall of the bearing rib of a bobbin basket according to this invention that includes wear-reducing inserts spaced alternately at the top and bottom of the bearing rib.

DETAILED DESCRIPTION OF BEST MODE

A detailed description of the best mode of practicing the present invention will now be provided by reference to the drawings.

General Configuration of Bobbin Basket

Figure 1:
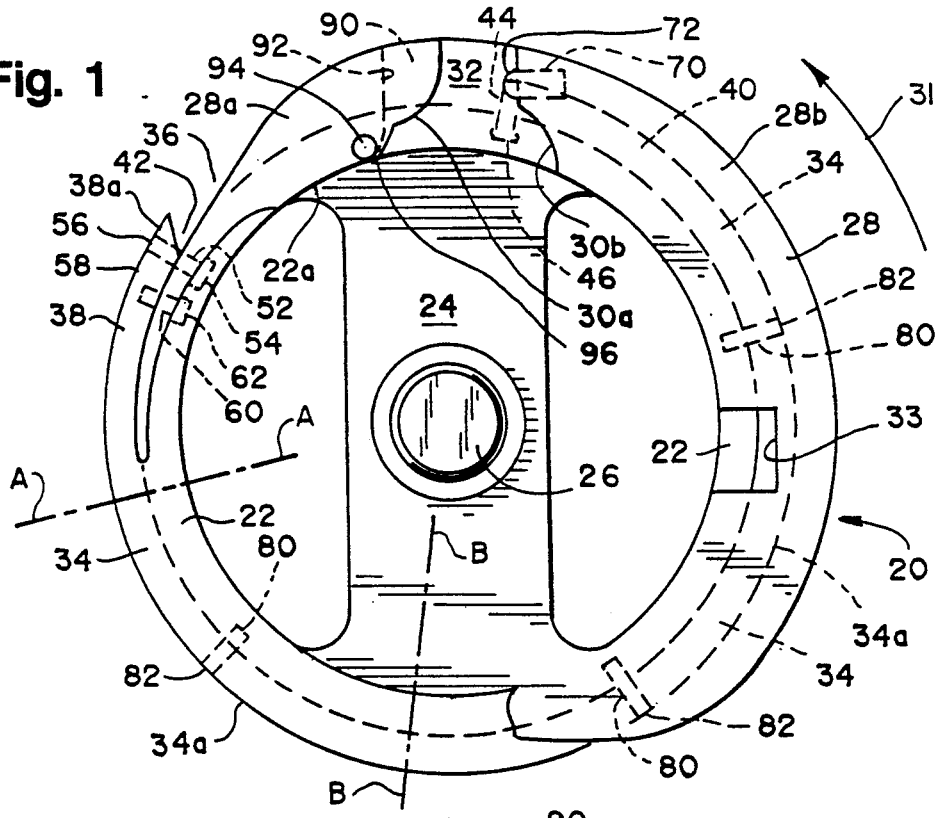
FIG. 1 is a top plan view of one embodiment of the bobbin basket of this invention adapted for use with a horizontal rotary loop taker in a sewing machine that is equipped with an undertrimmer.

Plastic bobbin basket 20, seen in top plan view in FIG. 1, includes cylindrical side wall 22, crosswise support member 24 extends across the bottom of the bobbin basket, bobbin spool support post 26 extending axially from support member 24 into the space defined by side wall 22, and flange 28 extending radially from the top portion of the side wall.

Portions **28*a* and 28*b* of flange 28 form oppositely facing side walls 30*a* and 30*b* that are positioned generally radially to form rotation-restraining notch 32 in the top surface of flange 28. First notch side wall 30*a* forms the downstream side of rotation-restraining notch 32, relative to the direction of rotation 31 (in FIG. 1, counterclockwise) of the rotary loop taker with which bobbin basket 20 is adapted to be used. Second notch side wall 30*b* forms the upstream side, relative to the direction of hook rotation, of rotation-restraining notch 32. Notch 32 is adapted to receive the stud portion of the stationary positioning finger (shown in FIG. 5**) with a secure but sufficiently loose fit to permit limited back-and-forth rotational movement of the bobbin basket.

A second notch 33 is provided at the inside perimeter of flange 28, on the right-hand side of FIG. 1. In use, a projection from the bobbin case which contains the bobbin spool is seated in this notch to align the case properly and to keep the case from rotating on post 26.

Annular bearing rib 34 extends radially outward from cylindrical side wall 22. It is located at the midportion of side wall 22 between flange 28 at the top of the bobbin basket and the bottom of the basket. The rib extends substantially around the perimeter of the bobbin basket except for a minor portion of the rib that is omitted at 36 to provide two oppositely facing rib end portions 38 and 40 that define a needle thread pick-up and release area.

Rib end portion 38 forms "V"-shaped pick-up notch 42 at the downstream end, relative to direction of hook rotation 31, of the needle thread pick-up and release area. Rib end portion 40, located adjacent rotation-restraining notch 32, forms needle thread stop 44 at the upstream end, again relative to the direction of hook rotation, of the needle thread pick-up and release area.

Except that all the members mentioned just above are integrally formed of plastic, the configuration of bobbin basket 20 as thus far described is conventional.

Figure 2:
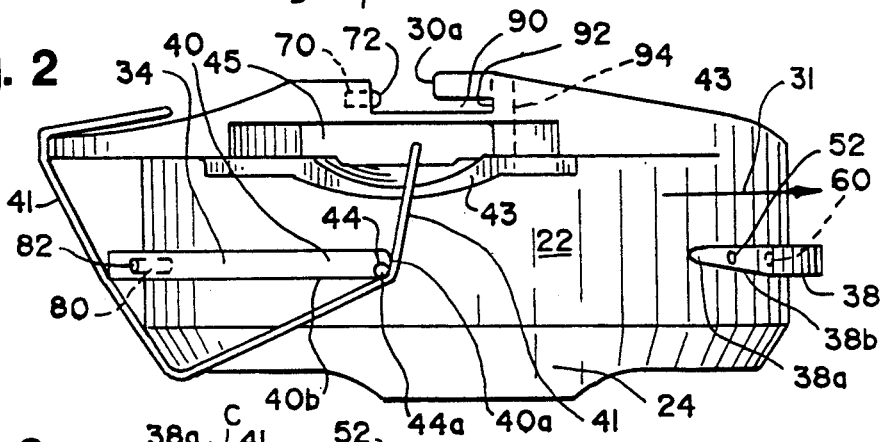
FIG. 2 is a side elevation of the embodiment of FIG. 1 as seen when looking at that embodiment from the top of the latter Figure.

Needle guard plate 43 in FIG. 2 is of the type disclosed and claimed in applicant's previously issued U.S. Pat. No. 4,858,543 referred to above. It is included in the illustrated plastic bobbin basket to prevent damage to cylindrical wall 22 if a needle used with the horizontal hook with which this basket is adapted to be used should be accidentally deflected downward as it moves forward to enter needle-receiving space 45. (Plate 43 is omitted from FIG. 1 for clarity.)

Guard plate 100 in FIGS. 5 and 6 is a different form of the needle guard plate which is illustrated in FIG. 4*a* of U.S. Pat. No. 4,858,548. It prevents damage to the cylindrical side wall of the bobbin basket of FIGS. 5 and 6 if the needle does not properly enter needle-receiving space 102. Plate 100 is secured to cylindrical side wall 22' of bobbin basket 20' (1) by embedded portion 104, (2) by embedded pins 110 with enlarged inner ends 112 and (3) by adhesive bonding.

Wear on Needle Thread Stop

Bearing rib 34 includes means for reducing wear on the needle thread stop that is formed by rib end portion 40, as needle thread loop 41 comes into contact with the stop (as shown in FIG. 2) and the thread is pulled forcefully across the stop to move it into position to tighten the loop around the bobbin thread. In the embodiment of FIG. 1, this wear-reducing means comprises cylindrical insert 44 embedded securely within rib end portion 40. Insert 44 is also embedded within cylindrical side wall 22, with its inner end 46 enlarged to provide a more secure attachment.

As best seen in FIG. 2, a portion 44*a* of the cylindrical exterior surface of insert 44 is substantially flush with the surrounding surfaces 40*a* and 40*b* of rib end portion 40, but is still exposed slightly to reduce wear on the end surface of the needle thread stop as thread 41 comes into contact with the stop and is thereafter pulled up across the stop to tighten the needle thread around the bobbin thread. (Only a portion of needle thread loop 41 is shown in FIG. 2; the thread of course extends in each direction up to the needle, beyond the ends of the portion of thread that is shown in this Figure.)

In the embodiment of FIGS. 5 and 6, insert 44' is embedded in the needle thread stop formed by end portion 40' of bearing rib 34' and in cylindrical side wall 22'.

Wear on Needle Thread Pick-Up Notch

Inserts for reducing wear on rib end portion 38, which with side wall 22 forms a pick-up notch 42 having a "V" shape in a plane perpendicular to the axis of rotation of the associated rotary loop taker, are included in the embodiment of the bobbin basket of this invention that is illustrated in FIGS. 1 through 4. In the operation of the sewing machine, the needle thread loop is caught in notch 42 and moves axially across the notch as the rotary loop taker rotates and enlarges the loop.

Figure 3:
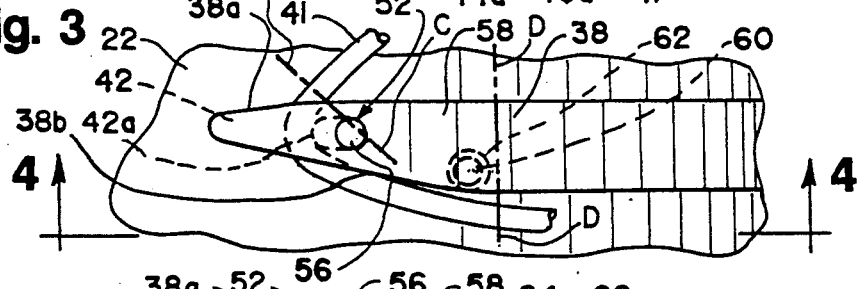
FIG. 3 is an enlarged, fragmentary view of the end portion of the bearing rib that is seen on the right hand side of FIG. 2.
Figure 4:
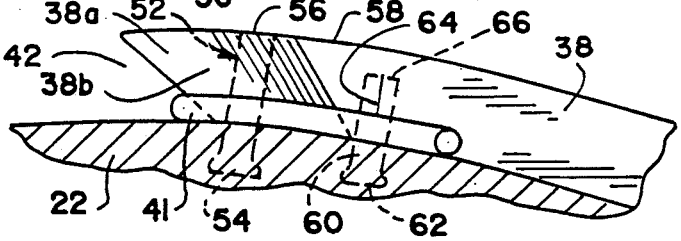
FIG. 4 is a sectional view of the fragmentary showing of FIG. 3 taken along line 4—4 in the latter Figure, which provides a bottom plan view of the bearing rib that is seen in FIG. 3.

As best seen in FIGS. 3 and 4, outer part 38*a* of rib end portion 38 extends in a circumferential direction to form pick-up notch 42 with cylindrical side wall 22. As the hook rotates around the bobbin basket (toward the right in FIG. 3) needle thread loop 41 is caught by this pick-up notch.

As shown in this embodiment, wear-reducing insert 52 is embedded partly in side wall 22 of the bobbin basket, and partly in rib end portion 38, in the vicinity of the bottom of "V"-shaped pick-up notch 42. Again, as with wear-reducing insert 44 described above, inner end 54 of insert 52 is enlarged to produce a more secure embedding in side wall 22, and exposed outer end 56 of this insert is substantially flush with the surrounding portion 58 of the outer side wall of rib end portion 38.

As shown in FIGS. 3 and 4, in this embodiment outer end 38*a* of rib end portion 38 is tapered slightly inward at the end portion of bottom side 38*b* of the rib. Second wear-reducing insert 60 is securely embedded partly in bobbin basket side wall 22, and partly in rib end portion 38, in the vicinity of the beginning of the tapered end section of rib portion 38.

Enlarged portion 62 of this insert helps to provide a secure attachment of the insert to side wall 22. Here, again, as with portion 44*a* of insert 44 described above, a portion 64 of the cylindrical exterior surface of insert 60 is exposed to contact with needle thread 41. Outer end 66 of insert 60 can, if desired, be flush with the outer side wall of rib end portion 38, but in this embodiment the insert terminates within the bearing rib.

In the embodiment of FIGS. 5 and 6, tapered rib end portion 38*a'* forms needle thread pick-up notch 42' with cylindrical side wall 22'. This embodiment includes only one embedded insert to reduce wear at the pick-up notch, which is insert 52.

Impact Damage on Wall of Rotation-Restraining Notch

As shown in FIGS. 1 and 2, insert 70 is securely embedded in upstream (relative to direction of rotation 31 of the rotary loop taker side wall 30*b* of rotation-restraining notch 32 that is formed by flange portion 28*b*. In this embodiment, insert 70 protrudes a short distance beyond the surrounding surface of side wall 30*b*. Outer end 72 of insert 70 is in this embodiment rounded in shape.

Although end 72 is shown as protruding beyond the surrounding surface of the flange portion in which it is embedded, if desired the insert may be flush with that surrounding surface or even buried slightly below the surface with no part exposed. In any such case, the outer end 72 of the insert is preferably a flat surface.

Insert 70 acts to minimize impact damage to wall 30*b* that would otherwise be caused by the stud portion of the stationary positioning finger (member 122 in FIG. 6) as bobbin basket 20 is jerked back and forth by the needle thread loop to cause wall 30*b* to strike the stud repeatedly as tension is applied to the thread of the needle thread loop first in one direction and then in the other. Insert 70 may be formed of any material that has a substantially higher impact strength than the main material of which bobbin basket 20 is formed does. A steel insert, for example, has been found to be suitable for use in this insert to minimize impact damage as described.

The means for minimizing impact damage to the upstream side wall of rotation-restraining notch 32 may be a member of any suitable shape, and may or may not be embedded in flange portion 28*b*. A rectangular plate of suitable size may, for example, be bonded to the surface of wall 30*b* or secured to the wall by a protuberance on the back of the plate that is embedded in the wall.

In the embodiment of FIGS. 5 and 6, the impact damage-minimizing member is insert 70' securely embedded in flange portion 28b' on the upstream side (relative to the direction of hook rotation 31', which is toward the right in FIG. 5 and counterclockwise in FIG. 6) of rotation-restraining notch 32'. During operation of the sewing machine, wall 120 of stud 122 of positioning finger 124 is struck by pin 70' as bobbin basket 20' is jerked back and forth by the needle thread.

Wear on Rib Body

In addition to the frictional and abrasive wear that can occur at the pick-up notch and the needle thread stop notch at rib end portions 38 and 40, respectively, there may be wear from the frictional contact between the entire body of bearing rib 34 and the raceway on the inner wall of the rotary loop taker in which the rib is journaled as the hook rotates around the basket. Applicant has discovered that it is not necessary to pay special attention to the entire body of the rib by selecting a particular material by which it is formed or coated, but it is sufficient to space a plurality of inserts around the extent of the rib body.

In the embodiment of FIGS. 1 and 2, inserts 44 and 52 already described above are among the inserts that are utilized for this purpose. In this embodiment, three additional inserts 80 are spaced along the extent of bearing rib 34. Each of these additional inserts has its outer end 82 exposed and substantially flush with and having the same cylindrical shape as, the outer side wall of the bearing rib. As a result, inserts 44, 52 and 82 all function to reduce the frictional wear between the outer wall of bearing rib 34 and the raceway. If desired, inserts 44, 52 and 82 may have outer ends that are rounded in shape and protrude slightly from the bearing rib.

If it is desired to use only two inserts to reduce wear on the outer wall of the rib body, insert 44 need not be extended to expose its outer end to contact with the raceway, and a single insert with an exposed outer end can be positioned diametrically opposite insert 52. It is preferred, however, to have several inserts equally spaced about the perimeter of the bearing rib.

In the embodiment of FIGS. 5 and 6, inserts 44' and 52' (which are omitted for clarity from FIG. 6) cooperate with a plurality of inserts 80' embedded in bearing rib 34', with exposed outer ends 82' spaced along the extent of the rib, to reduce wear on the plastic bearing rib caused by the contact of the rib with the raceway of the metal rotary loop taker in which the rib is journaled.

FIG. 7 shows a developed view of the outer wall of bearing rib 34'', with tapered rib end portion 38a'' forming a needle thread pick-up notch (on the left-hand side of the Figure) and rib end portion 40'' forming a needle thread stop at the opposite end. In this embodiment, cylindrically shaped inserts 130 are spaced along, and embedded in, bearing rib 34'' with upwardly facing, slightly exposed, cylindrical surfaces that are substantially flush with the surface of upper wall 132 of the bearing rib. Cylindrically shaped inserts 134 are embedded in rib 34'' in the same way as inserts 130 except that they have downwardly facing, slightly exposed, cylindrical surfaces substantially flush with the surface of bottom wall 136 of the bearing rib. Inserts 130 and 134 alternate along the length of the bearing rib.

If it is positioned diametrically opposite to wear-reducing inserts such as members 44' and 52' in FIG. 5, even a single insert such as insert 130 or 134 will have an appreciable effect in reducing wear on the body of the bearing rib. It is preferred, however, to employ several such inserts, equally spaced along the bearing rib.

If desired, one or more of cylindrically shaped insert 130 embedded in the bearing rib 34'' may be positioned parallel to the outer wall of the bearing rib, in which case any such inserts may have flat, exposed end surfaces facing both up and down, to reduce wear on the upper and lower surfaces, respectively, of the bearing rib, with which they are substantially flush.

Wear on Flange Portion That Defines Downstream Side of Rotation-Restraining Notch In the embodiment of FIGS. 1 and 2, downstream side wall 30a of rotation-restraining notch 32 is of a reentrant type that provides a recessed groove 90 for the passage of the bobbin thread as it exits from the bobbin spool in a sewing machine of the undertrimmer type.

As the bobbin thread is paid out from the bobbin spool, usually through a hole in the container in which the spool is encased, it travels past inner wall 92 of recessed groove 90 of side wall 30a of the rotation-restraining notch. In this embodiment, cylindrical wear-reducing insert 94 is positioned at the innermost end of inner wall 92 of recess 90, and a small part 96 of the cylindrical exterior surface of insert 94 is exposed in the vicinity of the junction between inner walls 92 and 22a of recessed groove 90 and bobbin basket cylindrical side wall 22, respectively.

The embodiment of FIGS. 5 and 6 is not used with a sewing machine having an undertrimmer, and hence the downstream wall 30a' rotation-restraining notch 32', which is formed by flange portion 28a, does not have any recessed groove at the bottom of the notch. There will still be wear that should preferably be guarded against on the flange portion, member 28a' in these Figures, that defines the downstream side of rotation-restraining notch 32'. In this embodiment, flange portion 28a' defines bobbin thread groove 140 in its top surface. As seen in FIG. 6, groove 140 is oriented in direction 142, the direction in which the bobbin thread moves as it leaves the bobbin spool (not shown). Wear-reducing inserts 144 and 146 are embedded in flange portion 28a' at the bottom of groove 140 at the entry and exit ends, respectively, of the groove. The exposed top ends of inserts 144 and 146 have the same shape as the bottom of groove 140 and are flush with the groove bottom wall.

This fifth type of damage resistant member is believed to be the least important of those that have been discussed as elements of the plastic bobbin basket of this invention.

Further Properties of Damage Resistant Members

Several properties are common to the various damage resistant members that are described above.

Surprisingly, applicant has discovered that it is not necessary to provide damage resistant members that protect the entire area of potential wear or damage of a given type. Thus it is not necessary, for instance, to do as various prior art workers have done and form, or cover, the entire bearing rib of a bobbin basket with a selected material. It is only necessary to provide damage resistant members for a small fraction of the area that is identified as one in which damage may occur during use of the bobbin basket. As is seen from the various Figures of the accompanying drawings, the area occupied by each of the damage resistant members described above may fall in the range from a small fraction of the potential area of wear or impact damage to the entire area of potential wear or damage.

For example, it is seen from FIG. 1 that the lateral surface of outwardly extending rib 34 that is protected against wear by insert 82 in the lower left-hand part of the Figure extends from about line A—A to about line B—B. This is a distance, measured along the perimeter of rib 34, that is approximately 32 times the width of insert pin 82. From FIG. 2, it is seen that the vertical height of rib 34 is approximately 2 times the width of pin 82. The area of the radially outer surface of portion A—B of rib 34 is thus approximately 64 times as great as a square area having a width on each side equal to the width of pin 82. Adjusting for the circular shape of the outer surface of pin 82 shows that the outer surface of the pin occupies a little less than 1/80 of the total area of potential wear on rib body 34 in the surface that is protected by pin 82.

FIGS. 3 and 4 how that the wear on rib end portion 34 against which inserts 52 and 60 protect extends approximately from C—C to D—D. This distance is approximately six (or more) times the combined exposed surfaces of pins 52 and 50 against which the needle thread loop wears. Thus the exposed surface of the two inserts 50 and 60 is approximately 1/6 (or less) of the area of potential wear at this location.

It will also be observed from the accompanying drawings that at least one portion of the exterior surface of each of the wear-reducing inserts described above is exposed to contact with a curved, elongated area of the needle thread loop, rotary loop taker raceway, or bobbin thread with which it is associated. Each of said exposed surface portions is smooth and free of sharp edges. Moreover, the accompanying drawings show that the lengthwise radius of curvature of each of said exposed surface portions is no greater than the radius of curvature of the immediately surrounding surface of the bobbin basket element with which it is associated. (By "lengthwise radius of curvature" is meant the radius of curvature measured normal to the exposed end surface of the insert, and thus lengthwise of elongated inserts such as are shown in the drawing.) It will be noted from FIG. 2 that the radius of curvature of exposed surface portion 44*a* is either equal to or somewhat smaller than the radius of curvature of the immediately surrounding surfaces, that part of end surface 40*a* and bottom surface 40*b* of end portion 40. Likewise, from FIG. 3 it will be noted that the radius of curvature of wear-reducing insert 52 is substantially smaller than the radius of curvature of bottom 42*a* of pick-up notch 42. Similarly, it will be noted from FIG. 1 that the radius of curvature of exposed end surface 82 of each wear-reducing insert 80 is equal to the radius of curvature of outer wall 34*a* of bearing 34, and that the radius of curvature of the exposed exterior surface portion 96 of wear-reducing insert 94 is substantially less than the radius of curvature of the surrounding surfaces, which are inner wall 92 of recessed groove 90 and inner surface 22*a* of cylindrical side wall 22.

All the inserts for reducing wear at various locations in bobbin basket 20 that are described above may be formed of any suitable material that will resist either frictional or abrasive wear. The material may have a substantially lower coefficient of sliding friction, with the needle thread, rotary loop taker raceway and bobbin thread with which it is in contact during use in the sewing machine, than the main material of which bobbin basket 20 is formed has, or may be substantially harder than that material, or may have a substantially higher heat deflection temperature than that material, or may have any two or three of these properties. Suitable materials include ceramic, steel, refractory, a non-moldable plastic or the like, with ceramic being preferred.

In selecting the material to use in making the above described inserts for reducing wear on various parts of the bobbin basket that is caused by contact with the needle thread loop or bobbin thread, consideration must be given to the type of thread with which the bobbin basket is to be used, and in addition to the type of sewing machine on which it is to be used. Some threads will have higher coefficients of sliding friction with the part of the plastic bobbin basket, and with the exposed portions of the damage resistant member that they contact, than other threads do. Some threads will be more abrasive than others. The speed at which the sewing machine will be operated will of course affect the likelihood of wear from either friction or abrasion.

As already indicated above, the material of which the means for minimizing impact damage to the downstream side wall of the rotation-restraining notch is formed may be any material that has a substantially higher impact strength than the main material of which bobbin basket 20 is formed has.

Method of Manufacture of Inserts

Depending upon the particular sewing machine with which the bobbin basket is to be used and the conditions under which the machine will be used, all or any number of the damage resistant means that comprise the plastic bobbin basket of this invention may be included in the basket.

The various wear-reducing inserts described above can be positioned in the mold in which the main portion of the plastic bobbin basket is to be produced, and the bobbin basket can be molded around those inserts.

On the other hand, if desired the plastic bobbin basket may be first molded in its entirety, and thereafter holes bored in the resulting product with the desired inserts then secured in the holes, either adhesively bonded or with a tight fit or press fit that will insure that they remain in place during use of the bobbin basket. If any exposed surfaces of the inserts do not already have the desired shape when installed in place, they can then be machined, ground or polished to a surface that is flush with, and preferably has the same cross-sectional shape as, the surface of the member surrounding that exposed surface. Surface 56 of insert 52 and surfaces 82 of inserts 80, for example, can be treated to form surfaces that are continuations of (or blend smoothly with) the curvilinear surfaces that surround them. The same can usually be done for the exposed surfaces of other inserts.

While the present invention has been described above and illustrated in the accompanying drawing in connection with the best mode presently contemplated by the inventor for carrying out his invention, the preferred embodiments described and shown are for purposes of illustration only, and are not to be construed as constituting any limitation of the invention. Modifications will be obvious to those skilled in the art, and all modifications that do not depart from the spirit of the invention are intended to be included within the scope of the appended claims.

I claim:

1. A bobbin basket for use with a rotary loop taker in a lock-stitch sewing machine, which basket comprises:

a cylindrical side wall, a crosswise support member for the cylindrical side wall extending across the bottom of the bobbin basket, a bobbin spool support post extending axially from said crosswise support member into the space defined by said cylindrical side wall, a flange extending radially outward from the top portion of said cylindrical side wall, two portions of said flange forming first and second oppositely facing side walls that are positioned generally radially to form a rotation-restraining notch in the top surface of the flange, said first notch side wall forming the downstream side of the rotation-restraining notch relative to the direction of rotation of the rotary loop taker with which the bobbin basket is adapted to be used, said second notch side wall forming the upstream side of said notch relative to said direction of rotation, said notch being adapted to receive the stud portion of a stationary positioning finger with a secure but sufficiently loose fit to permit limited back-and-forth rotational movement of the bobbin basket, and an annular bearing rib extending radially outward from said cylindrical side wall, said rib being located between the aforesaid outwardly extending flange and the bottom of the bobbin basket and extending substantially around the periphery of the bobbin basket except for a minor portion of said annular rib that is omitted to provide two oppositely facing rib end portions that define a needle thread pick-up and release area, the first of said oppositely facing rib end portions forming a pick-up notch at the downstream end, relative to the aforesaid direction of rotation of the rotary loop taker with which the bobbin basket is adapted to be used, of the needle thread pick-up and release area, and the second of said oppositely facing rib end portions being located adjacent said rotation-restraining notch to form a needle thread stop at the upstream end, relative to said direction of rotation, of the needle thread pick-up and release area, characterized in that:

(a) the bobbin basket, including said cylindrical side wall, said outwardly extending flange and said outwardly extending bearing rib, is integrally formed of plastic, (b) said bearing rib includes means for reducing wear on said second, upstream rib end portion that forms the aforesaid needle thread stop, as the needle thread loop comes into contact with said stop and the thread is pulled forcefully across the stop to tighten the loop around the bobbin thread, (c) said bearing rib includes means for reducing wear on said first, downstream rib end portion that forms the aforesaid pick-up notch, as the needle thread loop is caught in said notch and moves axially across the notch as the rotary loop taker rotates and enlarges the loop, (d) said second, upstream side wall of the rotation-restraining notch includes means for minimizing impact damage to said second side wall caused by the aforesaid stud portion of the stationary positioning finger as the bobbin basket is jerked back and forth by the needle thread loop to cause said second side wall to strike said stud repeatedly as tension is applied to the thread of the needle thread loop first in one direction and then in the other, (e) said bearing rib includes means for reducing wear on the rib body caused by the rotary loop taker raceway in which the rib is journaled, while at the same time substantial contact is maintained between the raceway and the rib body including said wear-reducing means, and (f) the area occupied by each of said means for reducing wear or minimizing impact damage at a given location on the bobbin basket falls in the range from a small fraction of the potential area of wear or impact damage at that given location to the entire area of potential wear or damage at that location.

2. The plastic bobbin basket of claim 1 in which:

(a) each of said means for reducing wear on said upstream and downstream rib end portions and on said rib body comprises at least one insert embedded securely within the bobbin basket element with which it is associated, and (b) said means for minimizing impact damage to the second, upstream side wall of the rotation-restraining notch comprises a member secured to said second side wall.

3. The plastic bobbin basket of claim 2 in which:

(a) at least one portion of the exterior surface of each of said wear-reducing inserts is exposed to contact with a curved, elongated area of the needle thread loop or rotary loop taker raceway with which it is associated, each of said exposed surface portions being smooth and free of sharp edges, the lengthwise radius of curvature of each of said exposed surface portions being not substantially greater than the radius of curvature of the immediately surrounding surface of the bobbin basket element with which is associated, and (b) at least one portion of the exterior surface of said impact damage-minimizing member is exposed to impact from the stud portion of said stationary positioning finger.

4. The plastic bobbin basket of claim 3 in which:

(a) said inserts for reducing wear on said upstream and downstream rib end portions and on said rib body are in each case formed of a material that has a substantially lower coefficient of sliding friction with the needle thread loop or rotary loop taker raceway, respectively, with which it comes into contact during use of the bobbin basket in a sewing machine, than the main material of which the bobbin basket is formed has, and (b) said member for minimizing impact damage to the second, upstream side wall of the rotation-restraining notch is formed of a material that has a substantially higher impact strength than the main material of which the bobbin basket is formed does.

5. The plastic bobbin basket of claim 3 in which:

(a) said inserts for reducing wear on said upstream and downstream rib end portions, and on said rib body are in each case substantially harder than the main material of which the bobbin basket is formed, and (b) said member for minimizing impact damage to the second, upstream side wall of the rotation-restraining notch is formed of a material that has a substantially higher impact strength than the main material of which the bobbin basket is formed does.

6. The plastic bobbin basket of claim 3 in which:

(a) said inserts for reducing wear on said upstream and downstream rib end portions and on said rib body have in each case a substantially higher heat deflection temperature than the main material of which the bobbin basket is formed has, and (b) said member for minimizing impact damage to the second, upstream side wall of the rotation-restraining notch is formed of a material that has a substantially higher impact strength than the main material of which the bobbin basket is formed has.

7. The bobbin basket of claim 3 in which each of said inserts for reducing wear has only a single surface exposed, which exposed surface is substantially flush with the surrounding surface of the element in which the insert is embedded.

8. The plastic bobbin basket of claim 3, in which said member for minimizing impact damage to the second, upstream side wall of the rotation-restraining notch is an insert that is embedded securely within said upstream side wall and protrudes a short distance beyond the surface of said side wall.

9. The plastic bobbin basket of claim 8, in which the portion of said member for minimizing impact damage that protrudes from the surface of the second side wall of said rotation-restraining notch is rounded in shape.

10. The plastic bobbin basket of claim 3, in which:

(a) the radially outer part of said downstream rib end portion extends circumferentially to form with the side wall of the bobbin basket a pick-up notch for the needle thread loop, said notch having a "V"-shape in a plane perpendicular to the axis of rotation of the associated rotary loop taker, and (b) an insert to reduce wear is embedded partly in the bobbin basket side wall, and partly in the rib end portion, in the vicinity of the bottom of said "V"-shaped notch.

11. The plastic bobbin basket of claim 10, in which:

(a) said circumferentially extending downstream rib end portion is tapered slightly inward adjacent the end of the bottom side of the bearing rib, and (b) a second insert to reduce wear is embedded partly in the bobbin basket side wall, and partly in the rib end portion, in the vicinity of the beginning of said tapered portion of said rib end portion.

12. The plastic bobbin basket of claim 3 which includes a plurality of inserts to reduce wear embedded in the body of the annular bearing rib.

13. The plastic bobbin basket of claim 12 which includes at least one insert for reducing wear on said annular rib body that has an outwardly facing exposed surface that is substantially flush with the surface of the outer wall of the bearing rib body.

14. The plastic bobbin basket of claim 12, which includes at least one insert for reducing wear on said annular bearing rib body that has an upwardly facing exposed surface that is substantially flush with the surface of the upper wall of the bearing rib body.

15. The plastic bobbin basket of claim 12, which includes at least one insert for reducing wear on said annular bearing rib body that has a downwardly facing exposed surface that is substantially flush with the surface of the lower wall of the bearing rib body.

16. The plastic bobbin basket of claim 12, in which a plurality of inserts for reducing wear on said annular bearing rib body is spaced around the extent of the bearing rib, with exposed surfaces of adjacent inserts being located alternately at the upper and lower surfaces of the bearing rib, and other exposed surfaces of the inserts facing outwardly at the surface of the outer wall of the bearing rib body.

17. A bobbin basket for use with a rotary loop taker in a lock-stitch sewing machine, which basket comprises:

a cylindrical side wall, a crosswise support member for the cylindrical side wall extending across the bottom of the bobbin basket, a bobbin spool support post extending axially from said crosswise support member into the space defined by said cylindrical side wall, and a flange extending radially outward from the top portion of said cylindrical side wall, two portions of said flange forming first and second oppositely facing side walls that are positioned generally radially to form a rotation-restraining notch in the top surface of the flange, an annular bearing rib extending radially outward from said cylindrical side wall and extending substantially around the periphery of the bobbin basket except for a minor portion of said annular rib that is omitted to provide two oppositely facing rib end portions that define a needle thread pick-up and release area, one of said oppositely facing rib end portions being located adjacent said rotation-restraining notch to form a needle thread stop at the upstream end, relative to the direction of rotation of the rotary loop taker with which the bobbin basket is adapted to be used, of the needle thread pick-up and release area, characterized in that:

(a) the bobbin basket, including said cylindrical side wall, said outwardly extending flange and said outwardly extending bearing rib, is integrally formed of plastic, and (b) said bearing rib includes means for reducing wear on said rib end portion that forms the aforesaid needle thread stop at the upstream end of the needle thread pick-up and release area, as the needle thread loop comes into contact with said stop and the thread is pulled forcefully across the stop to tighten the loop around the bobbin thread, the area occupied by said means for reducing wear on said needle thread stop falling in the range from a small fraction of the potential area of wear at that location to the entire area of potential wear at that location.

18. A bobbin basket for use with a rotary loop taker in a lock-stitch sewing machine, which basket comprises:

a cylindrical side wall, a crosswise support member for the cylindrical side wall extending across the bottom of the bobbin basket, a bobbin spool support post extending axially from said crosswise support member into the space defined by said cylindrical side wall, and an annular bearing rib extending radially outward from said cylindrical side wall, a portion of said annular rib being omitted to provide two oppositely facing rib end portions that define a needle thread pick-up and release area, one of said oppositely facing rib end portions forming a pick-up notch at the downstream end, relative to the direction of rotation of the rotary loop taker with which the bobbin basket is adapted to be used, of the needle thread pick-up and release area, characterized in that:

(a) the bobbin basket, including said cylindrical side wall and said outwardly extending .bearing rib, is integrally formed of plastic, and (b) said bearing rib includes means for reducing wear on said rib end portion that forms a pick-up notch, as the needle thread loop is caught in said notch and moves axially across the notch as the rotary loop taker rotates and enlarges the loop, the area occupied by said means for reducing wear on said pick-up notch falling in the range from a small fraction of the potential area of wear at that location to the entire area of potential wear at that location.

19. A bobbin basket for use with a rotary loop taker in a lock-stitch sewing machine, which basket comprises:

a cylindrical side all, a crosswise support member for the cylindrical side wall extending across the bottom of the bobbin basket, and a bobbin spool support post extending axially from said crosswise support member into the space defined by said cylindrical side wall, a flange extending radially outward from the top portion of said cylindrical side wall, two portions of said flange forming first and second oppositely facing side walls positioned generally radially to form a rotation-restraining notch in the top surface of the flange, said first notch side wall forming the downstream side of the rotation-restraining notch relative to the direction of rotation of the rotary loop taker with which the bobbin basket is adapted to be used, said second notch side wall forming the upstream side of said rotation-restraining notch relative to said direction of rotation, said notch being adapted to receive the stud portion of a stationary positioning finger with a secure but sufficiently loose fit to permit limited back and forth rotational movement of the bobbin basket, characterized in that:

(a) the bobbin basket, including said cylindrical side wall and said outwardly extending flange, is integrally formed of plastic, and (b) said second, upstream side wall of the rotation-restraining notch includes means for minimizing impact damage to said second side wall caused by the aforesaid stud portion of the stationary positioning finger as the bobbin basket is jerked back and forth by the needle thread loop to cause said second side wall to strike said stud repeatedly as tension is applied to the needle thread loop first in one direction and then in the other, the area occupied by said means for minimizing impact damage to said second side wall falling in the range from a small fraction of the potential area of impact damage at that location to the entire area of potential wear at that location.

20. A bobbin basket for use with a rotary loop taker in a lock-stitch sewing machine, which basket comprises:

a cylindrical side wall, a crosswise support member for the cylindrical side wall extending across the bottom of the bobbin basket, a bobbin spool support post extending axially from said crosswise support member into the space defined by said cylindrical side wall, and an annular bearing rib extending radially outward from said cylindrical side walls, characterized in that:

(a) the bobbin basket, including said cylindrical side wall and said outwardly extending bearing rib, is integrally formed of plastic, and (b) said bearing rib includes means for reducing wear on the rib body caused by the rotary loop taker raceway in which the rib is journaled, while at the same time substantial contact is maintained between the race way and the rib body including said wear-reducing means, the area occupied by said means for reducing wear on said rib body falling in the range from a small fraction of the potential area of wear at that location to the entire are of potential wear at that location.

21. A bobbin basket for use with a rotary loop taker in a lock-stitch sewing machine, which basket comprises:

a cylindrical side wall, a crosswise support member for the cylindrical side wall extending across the bottom of the bobbin basket, and a bobbin spool support post extending axially from said crosswise support member into the space defined by said cylindrical side wall, a flange extending radially outward from the top portion of said cylindrical side wall, two portions of said flange forming first and second oppositely facing side walls positioned generally radially to form a rotation-restraining notch in the top surface of the flange, said first notch side wall forming the downstream side of the rotation-restraining notch relative to the direction of rotation of the rotary loop taker with which the bobbin basket is adapted to be used, said second notch side wall forming the upstream side of said rotation-restraining notch relative to said direction of rotation, said notch being adapted to receive the stud portion of a stationary positioning finger with a secure but sufficiently loose fit to permit limited back and forth rotational movement of the bobbin basket, characterized in that:

(a) the bobbin basket, including said cylindrical side wall and said outwardly extending flange, is integrally formed of plastic, and (b) the portion of said flange that forms said first, downstream side wall of the rotation-restraining notch includes means for reducing wear on said flange portion caused by contact with the bobbin thread as it exits from the bobbin spool, the area occupied by said means for reducing wear on said first side wall falling in the range from a small fraction of the potential area of wear at that location to the entire area of potential wear at that location.

22. The plastic bobbin basket of claim 17, 18, 20 or 21, in which said means for reducing wear is formed of a material that has a substantially lower coefficient of sliding friction with the needle thread loop, rotary loop taker raceway, or bobbin thread with which it comes into contact during use of the bobbin basket in a sewing machine, than the main material of which the bobbin basket is formed does.

23. The plastic bobbin basket of claim 17, 18, 20 or 21, in which said means for reducing wear is formed of a material that is substantially harder than the main material of which the bobbin basket is formed.

24. The plastic bobbin basket of claim 17, 18, 20 or 21, in which said means for reducing wear is formed of a material that has a substantially higher heat deflection temperature than the main material of which the bobbin basket is formed has.

25. The plastic bobbin basket of claim 19, in which said means for minimizing impact damage is formed of a material that has a substantially higher impact strength than the main material of which the bobbin basket is formed does.

26. The bobbin basket of claim 1, in which the portion of said flange that forms said first, downstream side wall of the rotation-restraining notch includes means for reducing wear on said flange portion caused by contact with the bobbin thread as it exits from the bobbin spool, the area occupied by said means for reducing wear on said first side wall falling in the range from a small fraction of the potential area of wear at that location to the entire area of potential wear at that location.

27. The bobbin basket of claim 26, in which:

(a) said means for reducing wear on the portion of said flange that forms said first, downstream side wall of said rotation-restraining notch comprises at least one insert embedded securely within said flange, and (b) said means for minimizing impact damage to the second, upstream side wall of the rotation-restraining notch comprises a member secured to said second side wall.

28. The plastic bobbin basket of claim 1, in which at least one portion of the exterior surface of each of said wear-reducing means is exposed to contact with a curved, elongated area of the needle thread loop or rotary loop taker raceway with which it is associated, each of said exposed surface portions being smooth and free of sharp edges, the lengthwise radius of curvature of each of said exposed surface portions being not substantially greater than the radius of curvature of the immediately surrounding surface of the bobbin basket element with which it is associated.

29. The bobbin basket of claim 26 in which said means for reducing wear on said flange portion caused by contact with the bobbin thread as it exits from the bobbin spool has at least one portion of its exterior surface exposed to contact with a curved, elongated area of the bobbin thread with which it associated, each of said exposed surface portions being smooth and free of sharp edges, the lengthwise radius of curvature of each of said exposed surface portions being not substantially greater than the radius of curvature of the immediately surrounding surface of the flange that forms said first, downstream side wall of the rotation-restraining notch.

* * * * *